US005352122A

United States Patent [19]

Speyer et al.

[11] Patent Number: 5,352,122

[45] Date of Patent: Oct. 4, 1994

[54] ROTATABLE ELECTRICAL CONNECTOR

[76] Inventors: Henning J. Speyer, 3931 Longmeadow, Downers Grove, Ill. 60515; Franklin Fong, 761 Eastchester Rd., Wheeling, Ill. 60090

[21] Appl. No.: 990,958

[22] Filed: Dec. 15, 1992

[51] Int. Cl.[5] ..... H01R 39/02

[52] U.S. Cl. ..... 439/13; 439/27

[58] Field of Search ..... 439/11-13, 439/18, 21, 22, 27, 29, 530

[56] References Cited

U.S. PATENT DOCUMENTS

| | | | |
|---|---|---|---|
| 2,585,070 | 2/1952 | Allard | 439/13 X |
| 3,092,695 | 6/1963 | Abrams | 439/11 X |
| 4,026,618 | 5/1977 | Straka | 339/8 P |
| 4,583,798 | 4/1986 | Blazowich | 339/8 P |
| 4,753,600 | 6/1988 | Williams | 439/22 |

*Primary Examiner*—Eugene F. Desmond

*Attorney, Agent, or Firm*—Seidel, Gonda, Lavorgna & Monaco

[57] ABSTRACT

An electrical connector is formed from two pairs of contacts. One pair of contacts is rotatable with respect to the other pair of contacts. Both pairs are in conductive and frictional engagement throughout a 90 degree rotational distance. One pair of contacts have an arcuate conductive contact surface, each contact being symmetrically arranged with respect to the axis of rotation, in opposed relation to one another and separated at each end by a non-conductive space. One pair of contacts are attached to a pair of male electrical prongs. The other pair of contacts are attached to an electrical appliance. The one pair of contacts and the attached pair of male electrical prongs are themselves attached to a nonconductive disk. The nonconductive disk is disposed in a circular groove in a disk holder. The nonconductive disk and the pair of contacts and electrical prongs attached thereto are rotatable within the circular groove. Stops are employed to limit the rotational distance to 90 degree. The electrical connector allows an electrical appliance, such as a night light, attached to the connector to be oriented in a desired direction regardless of whether an outlet is vertically or horizontally disposed.

27 Claims, 5 Drawing Sheets

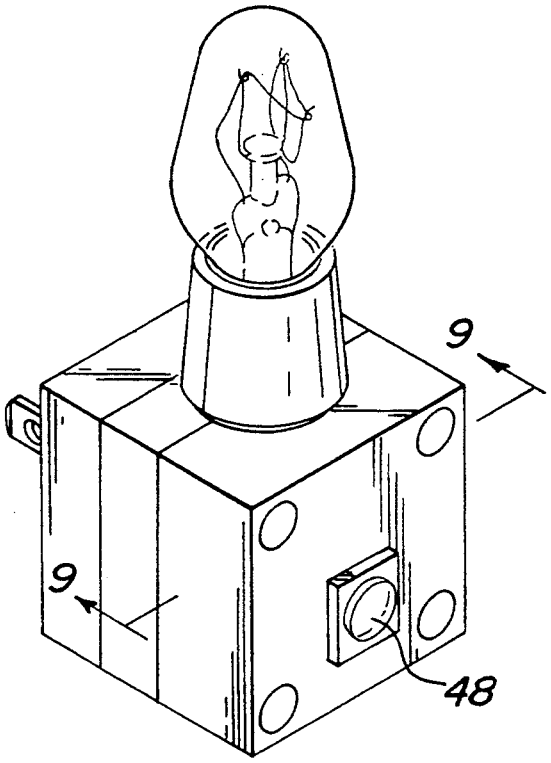
FIG. 8
FIG. 11
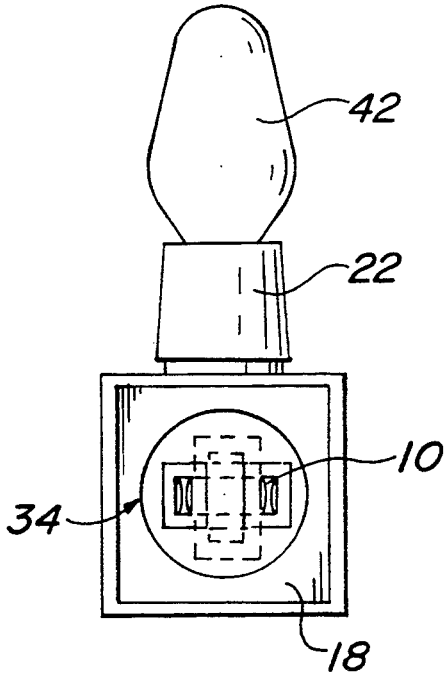
FIG. 3
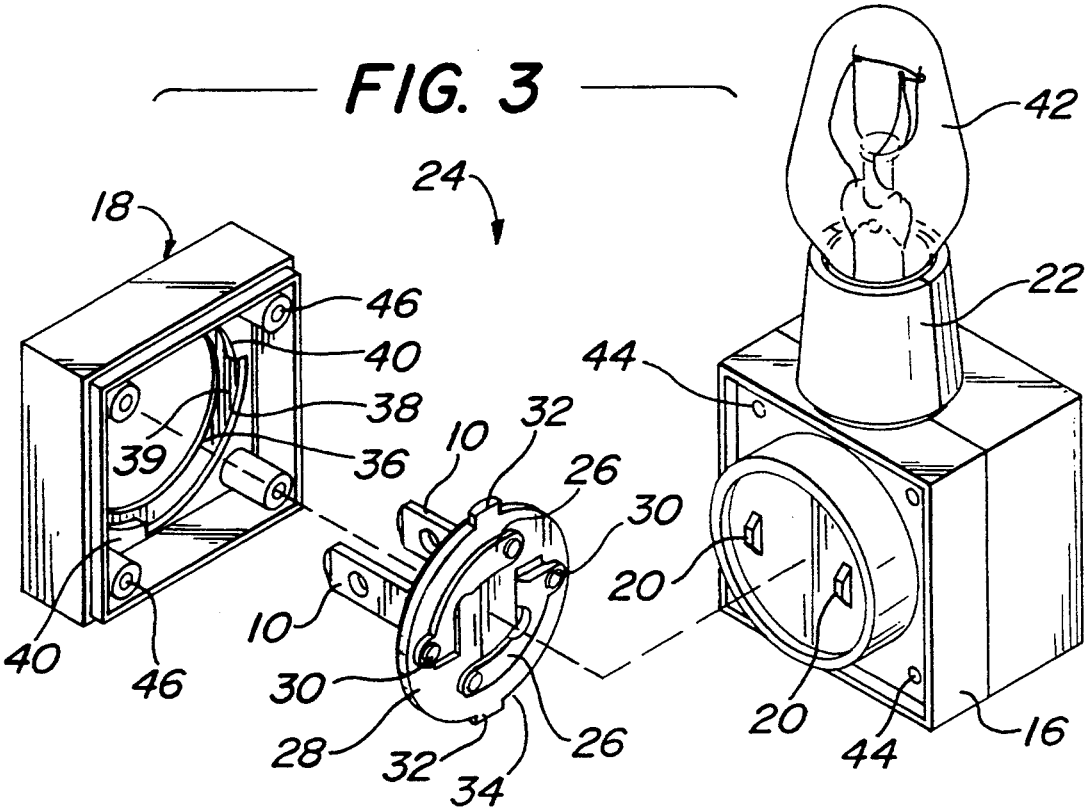

FIG. 5
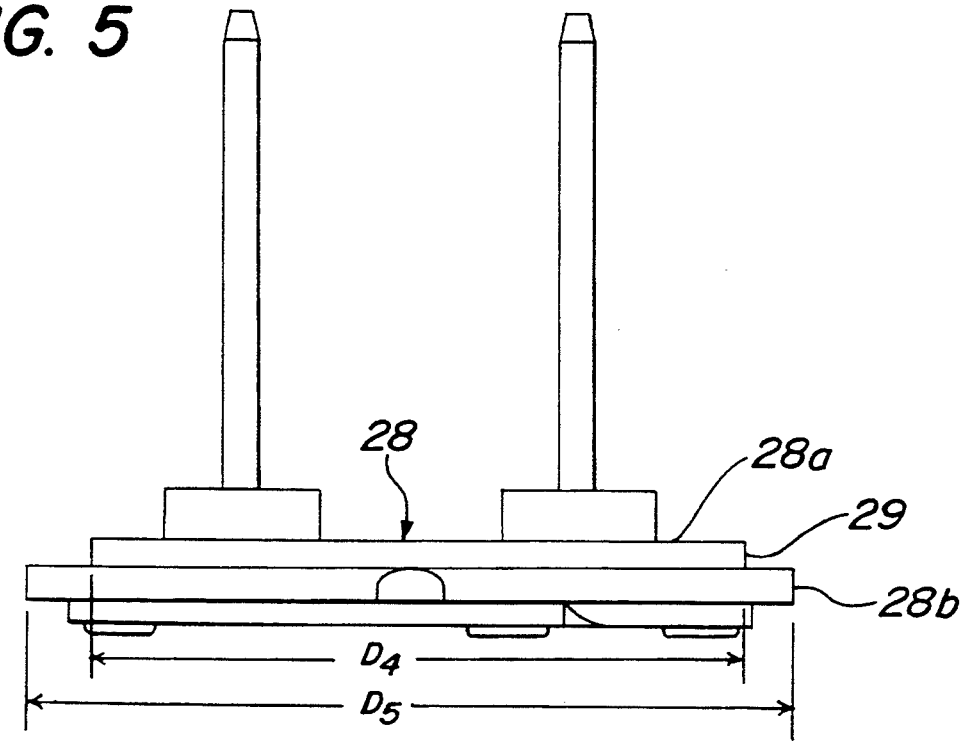
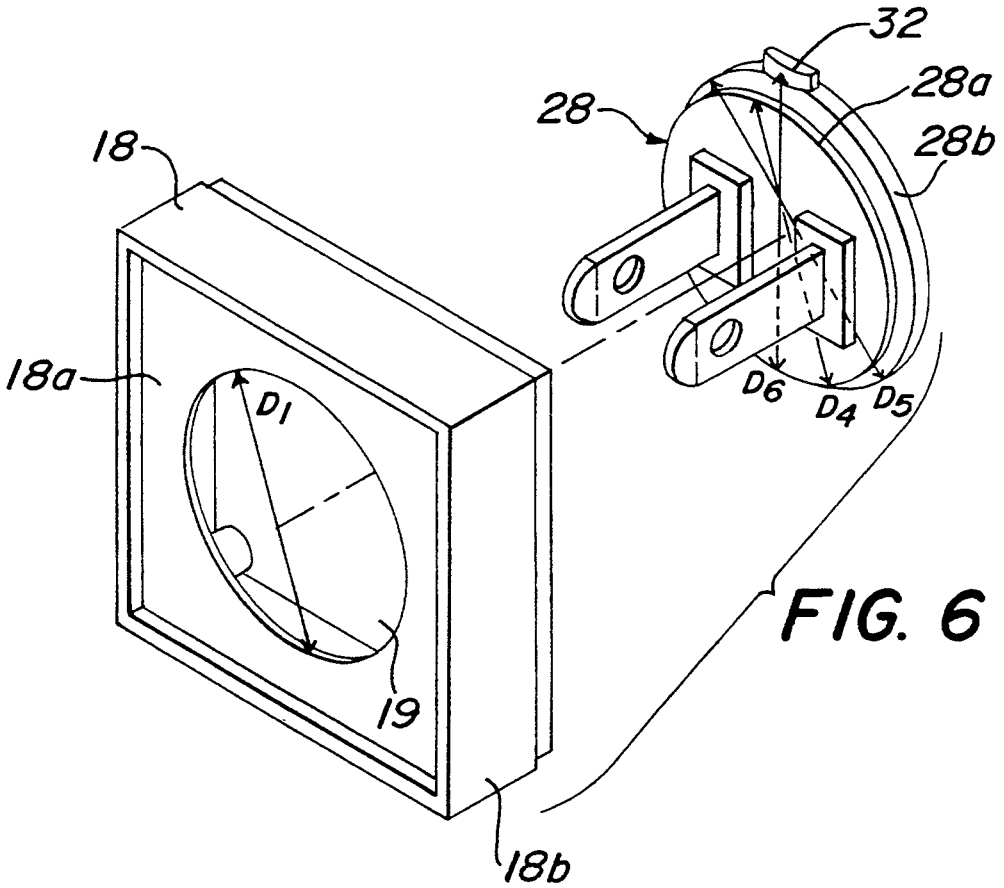
FIG. 6

ROTATABLE ELECTRICAL CONNECTOR

FIELD OF THE INVENTION

This invention relates to an electrical connector which allows for rotational movement of a part of the connector to accommodate different orientations of electrical outlets or different desired positions of electrical appliances attached to the connector. The invention is described in the context of, but is not limited to, a lighting appliance such as a night light.

BACKGROUND OF THE INVENTION

Rotatable electrical connectors which permit movement of one side of the connector with respect to the other side of the connector are known in the art. Typically, such connectors allow for 360 degree rotation of the two sides by the use of concentric annular coaxial contact surfaces and are designed to prevent twisting of cords connected thereto. For example, U.S. Pat. No. 4,583,798 discloses the use of a series of contact rings in alignment with contact elements, all disposed within a shell having an openended cylindrical bore. The contact rings are disposed on a barrel within the bore. The barrel is free to rotate about the bore as the cords attached to either end of the connector exhibit rotational movement, thereby preventing the cords from being twisted and kinked. Electrical contact is continuously maintained between the contact rings and the contact elements throughout the rotational movement.

U.S. Pat. No. 4,753,600 discloses a similar concept employing inner and outer copper circular rings. A pair of opposing plates are rotatably joined together by an axle around which the plates rotate so that during rotation, electrical current passes through both plates without interruption. Thus, for example, a tool being directed in a circular motion can be attached to the connector and can then be used continuously without concern of twisting or effective shortening of the electrical supply cord.

U.S. Pat. No. 4,026,618 discloses an electrical plug which is designed to be mounted to a wall socket. The electrical cord connected to the plug may be rotated to any point around a 360 degree path. Such a plug allows for a low profile (i.e., the plug extends outward a very short distance away from the wall socket) thereby allowing objects such as furniture to be positioned very close to the wall. If an electrical appliance is connected to the plug through the electrical cord, such a design allows the electrical cord to be turned around the plug as the orientation of the electrical appliance to the plug changes. These results are achieved by the use of a rotatable disk plate with concentric annular conductive ridges.

All of these patents have in common the fact that they are designed to allow free movement along a 360 degree path and are not designed to be set or held at any particular angular position.

The problem often arises that the orientation of the plug end of an electrical appliance prevents the use of an adjacent plug within the same electrical box. For example, the most common form of electrical outlet comes in pairs. A rotational feature allows for an electrical appliance such as a night light to make advantageous use of multiple plug electrical outlets, regardless of their original orientation against a wall or along an extension cord. However, in the prior art described above, the lack of a tight frictional contact between the two parts which rotate with respect to one another will not allow the electrical connector to remain in a desired fixed position. Also, any twisting of cords attached to the connector would provide sufficient force to change the connector's orientation. If an electrical appliance were directly attached to the connector, the resting position of the appliance in the outlet would depend upon gravitational forces instead of a desired functionally useful position (e.g., one that does not block other outlets or cause electrical cord to hang over other outlets) or an aesthetically pleasing position.

Certain types of plug-in appliances, such as clocks and lighting fixtures, have a required or preferred orientation but typically are furnished with an electrical plug whose orientation is fixed with respect to the appliance. Electrical wiring codes vary in different parts of the country. Some codes require outlets in the same electrical box to be positioned horizontally with respect to one another while other codes require outlets in the same electrical box to be positioned vertically with respect to one another. Such appliances are readily accommodated by an outlet of a given orientation but are not suitable for use with outlets oriented at 90 degrees from the given orientation.

There is still a need for a rotatable electrical connector which allows for movement between a limited angular range to accommodate different orientations of electrical plugs and outlets, which will stay fixed in a desired position unless physically moved and which can achieve these goals through a design that is simple to fabricate. The present invention fills that need.

SUMMARY OF THE INVENTION

The present invention defines an electrical connector formed from two pairs of electrical contacts. One pair of contacts is rotatable with respect to the other pair of contacts. A first pair of contacts have arcuate electrically conductive contact surfaces and are symmetrically arranged with respect to an axis of rotation. The first pair of contacts are in opposed relation to one another and are separated at each end by a non-conductive space. The second pair is meant to be connected to an electrical appliance. The two pairs of contacts are kept in frictional and electrical contact throughout a preselected degree of angular rotation. One of the pairs is connected to male prongs.

In another embodiment, the invention provides an electrical connector formed from two pairs of electrical contacts. One pair of contacts is rotatable with respect to the other pair of contacts. The two pairs of contacts are kept in frictional and electrical contact throughout a 90 degree rotation. Stops are employed to limit rotation to 90 degrees. One of the pairs is connected to male prongs.

The invention also provides an electrical connector formed from two pairs of electrical contacts, one pair of contacts being rotatable with respect to the other pair of contacts. A first pair of contacts have arcuate electrically conductive contact surfaces and are symmetrically arranged with respect to an axis of rotation. The first pair of contacts are in opposed relation to one another and are separated at each end by a non-conductive space. This first pair is connected to male electrical prongs. The second pair is mounted on a support and is connected to an electrical appliance. The two pairs of contacts are kept in frictional and electrical contact throughout a preselected degree of rotation. In this embodiment, the first pair of contacts and the electrical prongs attached thereto are fastened to a nonconductive disk which is seated into a groove in a disk holder. The nonconductive disk rotates within the groove to change the orientation of the electrical prongs with respect to the support.

The invention also provides for a frictional force sufficient to inhibit undesired spontaneous movement of the two sets of electrical contacts with respect to each other.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 3 is an exploded isometric view of one preferred form of a rotatable electrical connector in accordance with the present invention as viewed attached to the night light.

FIG. 5 is an enlarged side elevation view of the disk from its side.

FIG. 6 is an exploded isometric view of the disk and the disk holder.

FIG. 8 is a perspective view of a sensor-activated night light.

FIG. 11 is a perspective view of the night light when viewed with blades facing outward.

DESCRIPTION OF THE PREFERRED EMBODIMENT

Figure 1:
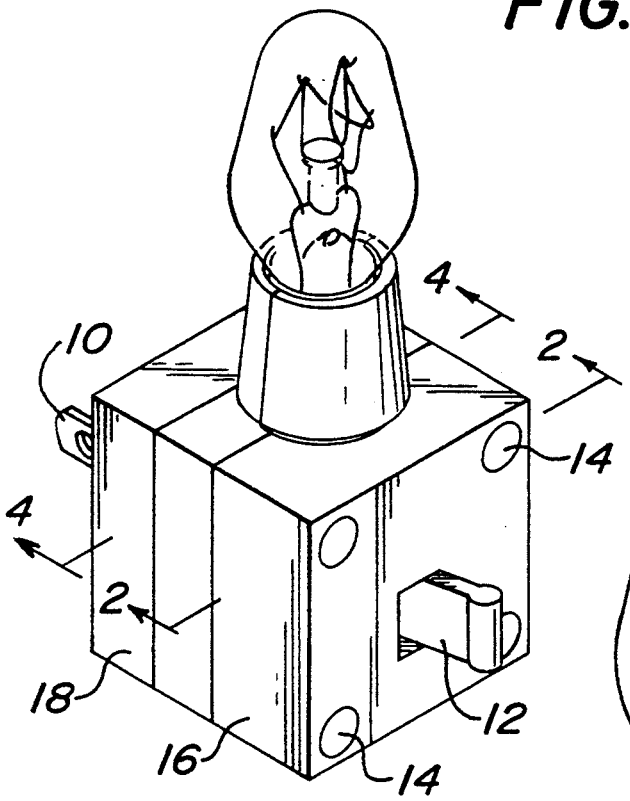
FIG. 1 is perspective view of one preferred form of a rotatable electrical connector in accordance with the present invention as viewed attached to a night light.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiments of the novel rotatable electrical connector are illustrated in the drawings.

FIG. 1 shows a perspective view of an exemplary end product, a night light, which incorporates therein the novel rotatable electrical connector. The night light is plugged into an electrical outlet by blades 10 (only one blade is visible in the isometric view) and controlled by on/off switch 12 of the rocker type. This view also shows countersunk screw holes 14 which receive screws that connect support 16 to disk holder 18, as described below.

Figure 2:
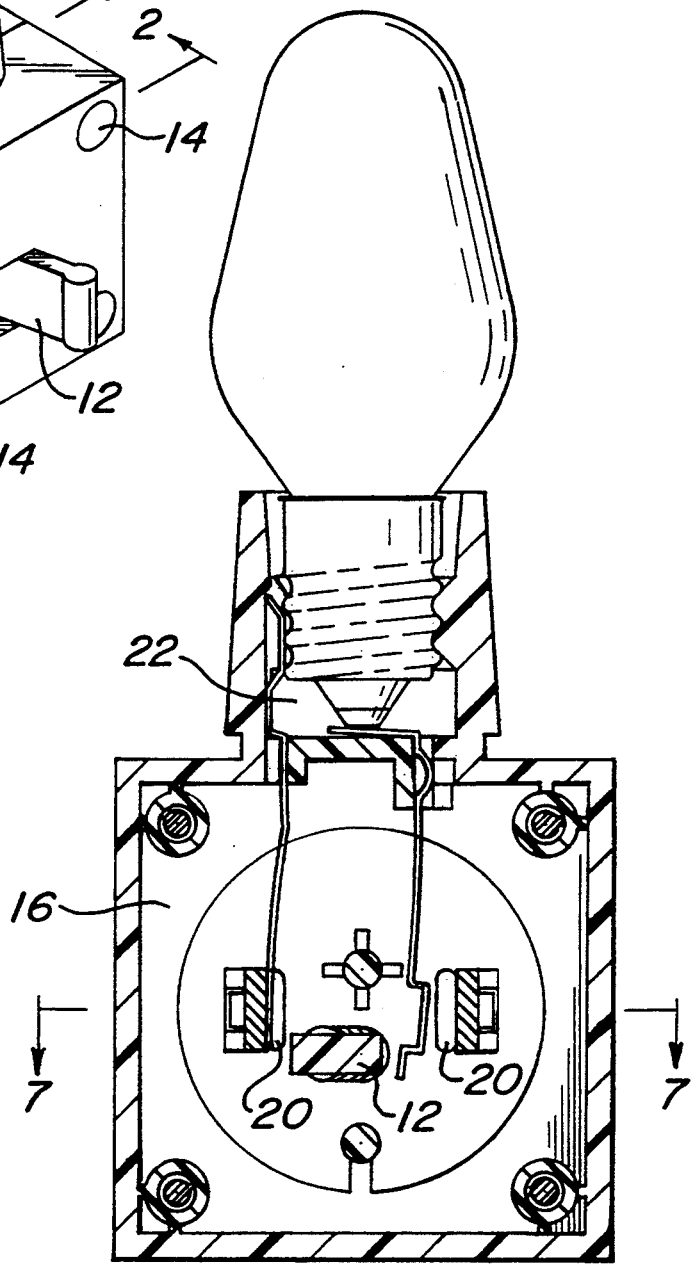
FIG. 2 is a sectional view of the night light taken along axis line 2—2 of FIG. 1.

FIG. 2 shows a sectional view of the back side of support 16 taken along axis line 2—2 of FIG. 1. Conductive contacts 20 protrude through to the back side of support 16 and are attached to an electrical conductor, electrical cord, or directly to whatever electrical appliance is desired to be operated. In this embodiment, the conductive contacts 20 are connected through switch 12 (shown in its "off" position) to a light bulb socket 22.

Turning now to FIG. 3, the components of assembly 24 will be described herein. Each of blades 10 are attached at one end to a respective conductive plate 26. Disk 28 is disposed between the conductive plates 26 and the blades 10. In the preferred embodiment, each blade 10 extends through disk 28 and is attached to one end of the conductive plate 26 on the inner facing side of the disk 28. Disk 28 is constructed of a nonconducting material, such as plastic. In the preferred embodiment, blade 10 and conductive plate 26 are formed of a single electrical conductor, bent at right angles to form a blade and plate portion. Each conductive plate 26 is adhered to the disk 28 by fasteners 30 on either side of the plate. Two tabs 32 extend radially outward at diametrically opposed locations on disk 28.

The conductive plates 26 lie flush against the inward facing side of the disk 28, i.e., the side of disk 28 which faces support 16. Conductive plates 26 preferably have an arcuate shape, are symmetrically arranged with respect to the center of disk 28, and are in opposed relation to one another. The ends of the plates are separated by a space so as to avoid creating an electrical short between the two blades.

Blades 10, plates 26 and disk 28 form a discrete subassembly 34. The entire blade/plate/disk subassembly 34 fits into circular groove 36 formed in disk holder 18. Groove 36 includes two oppositely disposed sections 38 (only one section is visible in the perspective view) having an arcuate recess 39 and two stop sections 40 at each end of arcuate recess 39. The diameter of the groove between oppositely disposed sections 38 is slightly larger than the diameter between the outer edges of tabs 32 on disk 28, as will be further described below. Disk holder 18 also includes threaded screw holes 46 at its corners.

FIG. 3 also depicts support 16 which provides a mounting structure for conductive contacts 20. These conductive contacts 20 lead to an electrical appliance such as bulb 42 screwed into socket 22. (The internal leads are not shown in this view.) Support 16 also includes screw holes 44 which line up with threaded screw holes 46 of disk holder 18 when fully assembled.

Assembly consists of placing the blade/plate/disk subassembly 34 into circular groove 36 so that tabs 32 lie flush against the oppositely disposed sections 38 of the groove. Then, disk holder 18 is fastened to support 16 by screws which are inserted into the back of the support 16 (depicted in FIG. 1 as screw holes 14) and which extend through hollow holes 44 and into threaded holes 46. After the screws are tightened, each conductive plate 26 will be in tight frictional contact with a respective conductive contact 20.

In operation, blades 10 are plugged into an electrical outlet. Thereafter, disk holder 18 and conductive contacts 46 mounted on support 16 are rotatable with respect to the blade/plate/disk subassembly 34. The arcuate shape of conductive plates 26 allows for their continuous electrical contact with respective contacts 20 throughout a limited rotational distance. As noted above, the rotational distance is limited by stop sections 40 within groove 36.

In the preferred embodiment, a 90 degree rotation is possible. When the orientation of the plug end of an electrical appliance prevents the use of an adjacent plug within the same electrical box, this 90 degree rotation feature allows for an electrical appliance such as a night light or an AC-DC transformer with blades at its output to make advantageous use of such outlets, regardless of the outlet's original orientation against a wall or on an extension cord. The assembled disk holder/support portion is merely rotated, if necessary, so as to not interfere with the use of an adjacent outlet. The stop sections ensure that the new orientation will be approximately 90 degrees from the old orientation so that if the holder/support portion is rectangular, it will always be at an aesthetically pleasing angle. The tight frictional contact also ensures that once placed in a desired position, the holder/support portion will not move on its own accord as it would in the prior art schemes described above. Even if the conductive contacts 20 were only connected to a cord, twisting of the cord would not provide enough force to move the orientation of the holder/support portion with respect to subassembly 34. In the prior art described above, such movement would result in potentially disadvantageous swiveling or rotating of the electrical connector.

Figure 4:
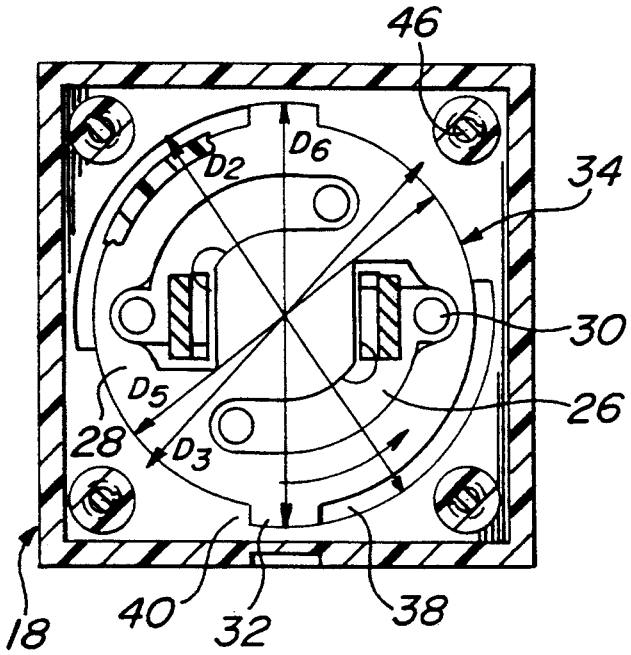
FIG. 4 is an enlarged transverse sectional view of parts of the connector including a disk placed within a rotatable disk holder taken along axis line 4—4 of FIG. 1.

FIG. 4 shows an enlarged sectional view of disk holder 18 with a disk 28 placed within the disk holder's groove. In this position, tabs 32 of the disk 28 abut stop sections 40. Blade/plate/disk subassembly 34 is free to rotate 90 degrees within the groove until the tabs 32 abut against respective oppositely facing stop sections 40.

Figure 7:
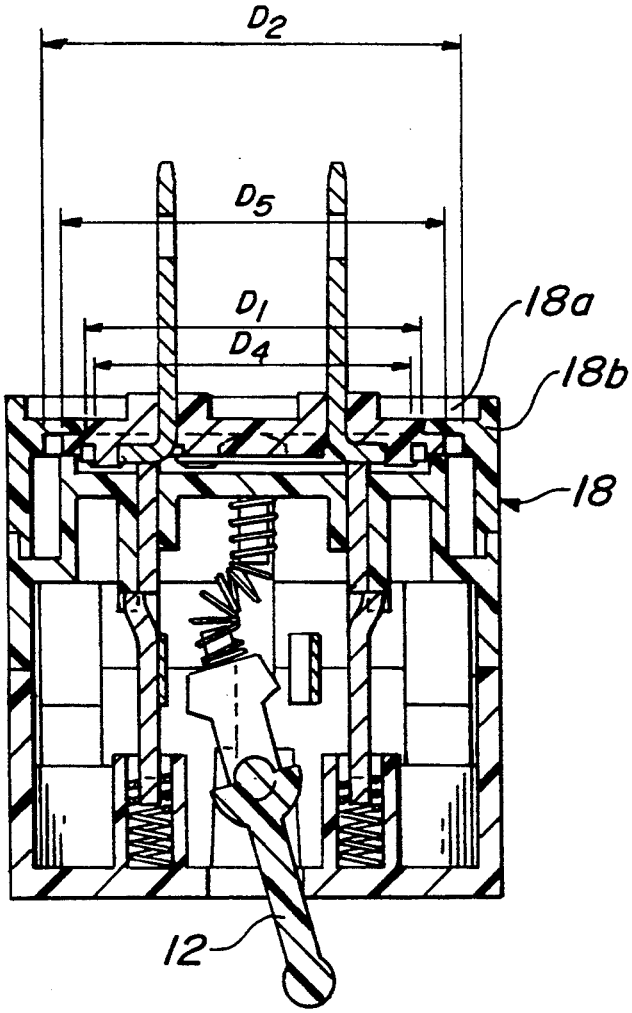
FIG. 7 is a sectional view of the night light taken along axis line 7—7 in FIG. 2 depicting details of the light's on-off switch.

FIG. 4, in combination with FIGS. 5–7, more clearly depicts the structure of disk 28 and the manner in which disk 28 fits into disk holder 18. The disk and disk holder are defined by portions having diameters $D_1$ through $D_6$.

FIG. 4 shows diameter $D_2$, which is the maximum diameter of groove 36 (only section 38 is visible), and diameter $D_6$ which is the maximum diameter of disk 28 (as taken between tabs 32). $D_2$ is slightly larger than $D_6$ so as to allow the disk to move within the groove. FIG. 4 also shows diameter $D_5$, which is the maximum diameter of disk 28 without tabs 32, and diameter $D_3$ which is the diameter of groove 36 measured between stop sections 40. $D_3$ is slightly larger than $D_5$ so as to allow the disk to move within the groove. Stop section 40 is defined by $D_2$ being larger than $D_3$.

FIG. 5 shows disk 28 in side elevation such that tabs 32 are not visible. The disk 28 has two portions, each defined by their own diameter. An upper portion **28*a* is defined by diameter $D_4$, while a lower portion 28*b* is defined by diameter $D_5$. $D_4$ is less than $D_5$. This defines a shoulder 29 circumferentially around disk 28 to help seat disk 28 in the opening in disk holder 18**, as will be now described.

FIG. 6 shows diameter $D_4$ associated with the upper portion **28*a* of disk 28 and diameter $D_5$ associated with the lower portion 28*b* of the disk. (In FIG. 4, only diameter $D_5$ associated with lower portion 28*b* is visible.) FIG. 6 also shows surface 18*a*, side wall 18*b*, and circular opening 19 of disk holder 18. Circular opening 19 has a diameter $D_1$ which is slightly larger than $D_4$. It should also be appreciated that $D_1$ must be less than $D_6$ so as to prevent the disk from slipping through opening 19** and is preferably, but not necessarily, less than $D_5$.

When disk 28 is placed within disk holder 18, only upper portion **28*a* is visible from the surface 18*a* of the disk holder 18. The upper portion 28*a* preferably lies flush with the surface 18*a* and the lower portion 28*b* lies within groove 36. Thus, after disk 28 is placed in disk holder 18, the lower portion 28*b* will be hidden from view, from the perspective of FIG. 6**.

FIG. 7 shows a sectional view of the exemplary night light embodiment taken along axis line 7—7 in FIG. 2 and more clearly depicts the internal operation of on-off switch 12 shown in FIG. 1. The construction and operation of the on-off switch is not unique to the present invention and, for that reason, need not be described in detail. FIG. 7 also shows surface **18*a* and side wall 18*b* of disk holder 18** and shows diameters $D_1$, $D_2$, $D_4$ and $D_5$ as they appear in cross-section.

FIG. 8 shows a perspective view of the exemplary night light embodiment similar to FIG. 1, except for the replacement of on-off switch 12 by photocell 48.

Figure 9:
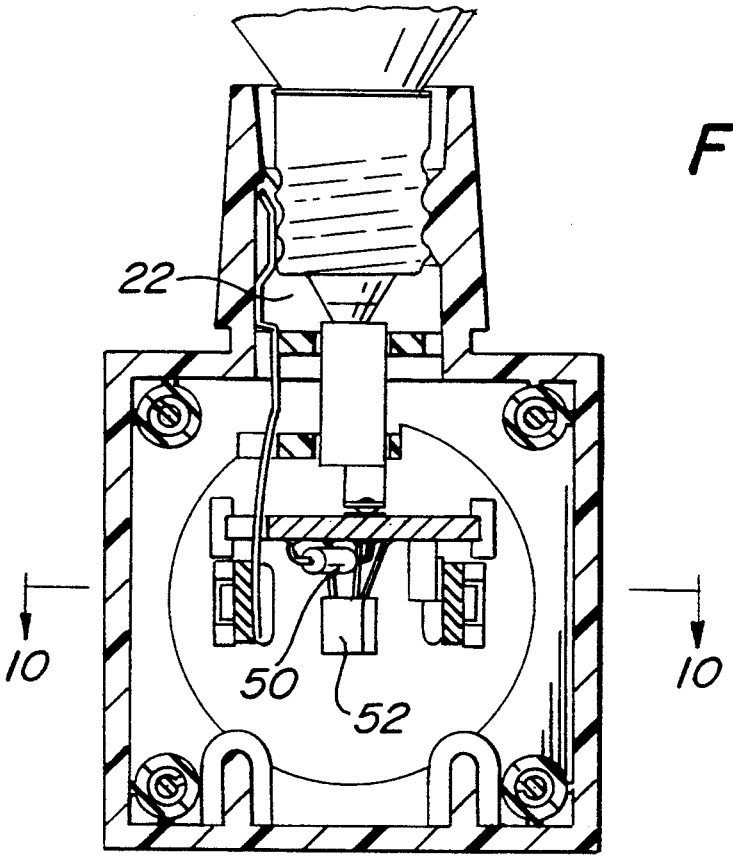
FIG. 9 is a sectional view of the circuitry related to the sensoractivated night light embodiment, taken along axis line 9—9 of FIG. 8.

FIG. 9 shows a sectional view of the circuitry related to photocell 48 shown in FIG. 8, taken along axis line 9—9 of FIG. 8. Circuitry comprising resistor 50 and transistor 52 are connected to the photocell 48 (depicted in FIG. 8) and cause selective activation and deactivation of power to socket 22 in accordance with the amount of light impinging upon the photocell.

Figure 10:
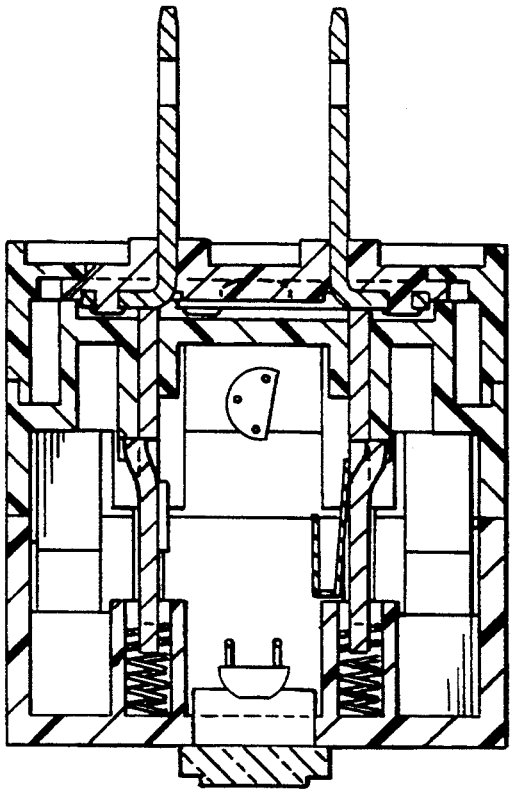
FIG. 10 is a sectional view of the night light taken along axis line 10—10 of FIG. 9.

FIG. 10 shows a sectional view of the exemplary night light embodiment taken along axis line 10—10 of FIG. 9.

FIG. 11 shows a perspective view of the exemplary night light embodiment when viewed with blades 10 facing outward from disk holder 18. The blade/plate/disk subassembly 34 can be oriented with respect to the remaining elements around a 90 degree range of position from a first position (as shown) to a second position (shown in phantom). In operation, a decorative or ornamental shade (not shown) can be placed around the socket 22 and bulb 42 area and attached to the night light. The shade can have partly opaque and partly translucent portions. The rotatable feature allows the light to be positioned in the preferred orientation. For example, if there is lettering or other printed matter on the shade, the shade can be oriented so that the lettering or other printed matter is properly oriented.

Although the preferred embodiments show the use of the invention for a night light, it should be understood that the invention is usable for connecting any electrical appliance to an electrical outlet. It should also be recognized that the blades 10 can be replaced by any male-type conductive connector that fits into a mating female socket. Thus, the invention is not limited to use with 110–120 V AC-type appliances.

Although the preferred embodiment discloses that blade 10 and conductive plate 26 are formed of a single electrical conductor, it should be recognized that single fabrication is not necessary. It is only required that blade 10 be electrically connected by some manner, and at some point, to plate 26.

It should also be appreciated that the respective positions of the conductive plates and conductive contacts could be easily reversed. Thus, the conductive contacts could be formed on the inside facing surface of disk 28 and the plates could be placed on support 16. Also, stop sections 40 which limit the rotation to 90 degrees need not be formed inside groove 36. The groove 36 could be formed with only a single depth and protrusions extending out from support 16 could butt against tabs 32, thereby the rotational distance. Alternatively, a single depth groove could be used and tabs 32 could extend outward from disk 28. In this embodiment, protrusions extending out from support 16 would, likewise, limit the rotational distance.

Lastly, it should be realized that the various parts of the electrical connector need not be held together by screws. Instead, glue or snap-together parts may be employed.

The novel rotatable electrical connector described above provides significant advantages not contemplated by prior art rotatable electrical connectors. The ability to maintain the connector at a desired rotational position provides functional and aesthetic advantages not available with freely rotating (360 degree) connectors. Also, the fabrication of conductive surfaces from simple shapes reduces the manufacturing complexity as compared to the use of annular rings of interengaging conductive material.

The present invention may be embodied in other specific forms without departing from the spirit or essential attributes thereof and, accordingly, reference should be made to the appended claims, rather than to the foregoing specification, as indicating the scope of the invention.

We claim:

1. A rotatable plug comprising:

first and second contact means defining arcuate electrically conductive contact surfaces, the first and second contact means being symmetrically arranged with respect to an axis of rotation, in opposed relation to one another and separated at each end by a non-conductive space;

first and second conductive means for electrically and frictionally contacting the arcuate electrically conductive contact surfaces of the first and second contact means, the first and second contact means being rotatable a preselected angular distance with respect to the first and second conductive means, respectively, while maintaining electrical contact throughout rotation;

means for keeping the first and second contact means and the first and second conductive means in frictional contact with one another, respectively;

first and second male prong means for insertion into a female electrical receptacle, the first and second male prong means being in fixed electrical contact with a preselected one of the set of first and second contact means, respectively, and the set of first and second conductive means, respectively;

a nonconductive disk means for carrying one of the preselected sets of first and second contact means and first and second conductive means, the preselected set being fastened to one side of the nonconductive disk means, the first and second male prong means extending through the disk means and protruding outward from the other side; and a holding means having outwardly facing and inwardly facing sides, the outwardly facing side having a circular opening of a first diameter for allowing the first and second male prong means to extend therethrough, the inwardly facing side having a circular groove therein, the nonconductive disk means and the preselected set fastened thereto being disposed within and rotatable within the circular groove.

2. A rotatable plug as recited in claim 1 wherein the angular distance is substantially defined by the length of one of the arcuate con tact surfaces.

3. A rotatable plug as recited in claim 2 wherein the angular distance is 90 degrees.

4. A rotatable plug as recited in claim 1 wherein the frictional contact is sufficient to inhibit undesired spontaneous movement of the first and second contact means with respect to the first and second conductive means.

5. A rotatable plug as recited in claim 1 wherein the groove of the holding means has a second diameter, the inwardly facing side of the holding means further having a stop means which comprises a portion of the groove having a third diameter which is less than the second diameter, the disk means further including a shoulder for defining an upper portion having a fourth diameter which is slightly less than the first diameter and a lower portion having a fifth diameter which is greater than the fourth and first diameter and slightly less than the third diameter, the disk means further comprising at least one tab extending radially outward from the lower portion, the lower portion of the disk means including the tab having a sixth diameter which is slightly less than the second diameter, wherein the upper portion of the disk means lies substantially flush with the outwardly facing side of the holding means, rotation of the disk means being limited by the tab contacting the portion of the groove having the third diameter.

6. A rotatable plug comprising:

first and second male prong means for insertion into a female electrical receptacle;

first and second contact means having electrically conductive contact surfaces, the first and second contact means being in fixed electrical contact with the first and second male prong means, respectively;

body means for providing a mounting support for first and second conductive means, the first and second conductive means comprising terminals for an electrical appliance attached thereto, the first and second conductive means being electrically and frictionally in contact with the electrically conductive contact surfaces of the first and second contact means, the first and second contact means being rotatable with respect to the first and second conductive means, respectively, while maintaining electrical contact throughout rotation;

stop means for permitting a maximum of 90 degrees of relative angular rotation between the first and second contact means and the first and second conductive means, respectively;

a nonconductive disk means for carrying the first and second contact means, the first and second contact means being fastened to one side of the nonconductive disk means, the first and second male prong means extending through the disk means and protruding outward from the other side; and a holding means having a circular groove therein of a preselected first diameter, the nonconductive disk means and the contact means fastened thereto being disposed within and rotatable within the circular groove.

7. A rotatable plug as recited in claim 6, wherein the nonconductive disk means includes at least one tab extending radially outward and wherein the stop means comprises a portion of the groove having a second diameter less than the first diameter, the angular rotation being limited by contact between the tab and the portion of the groove having the second diameter.

8. A rotatable plug comprising:

first and second male prong means for insertion into a female electrical receptacle;

first and second contact means for providing arcuate electrically conductive contact surfaces, the first and second contact means being symmetrically arranged with respect to an axis of rotation, in opposed relation to one another and separated at each end by a non-conductive space, the first and second contact means being in fixed electrical contact with the first and second male prong means, respectively;

body means for providing a mounting support for first and second conductive means, the first and second conductive means providing terminals for an electrical appliance attached thereto, the first and second conductive means being electrically and frictionally in contact with the arcuate electrically conductive contact surfaces of the first and second contact means, the first and second contact means being rotatable a preselected angular distance with respect to the first and second conductive means, respectively, while maintaining electrical contact throughout rotation;

a nonconductive disk means for carrying the first and second contact means thereto, the first and second contact means being fastened to one side of the nonconductive disk means, the first and second male prong means extending through the disk means and protruding outward from the other side; and a holding means having a circular groove therein of a preselected first diameter, the nonconductive disk means and the contact means fastened thereto being disposed within and rotatable within the circular groove.

9. A rotatable plug as recited in claim 8 wherein the nonconductive disk means further comprises at least one tab extending radially outward and the groove in the holding means further comprises stop means for limiting the angular rotatable distance of the nonconductive disk means to a preselected amount, thereby limiting the amount by which the body means and conductive means mounted thereto angularly rotate with respect to the contact means and the electrical prong means fastened thereto, the angular rotation being limited by contact between the tab and the stop means.

10. A rotatable plug as recited in claim 9 wherein the stop means comprises a portion of the groove having a second diameter less than the first diameter, the angular rotation being limited by the tab contacting the portion of the groove having the second diameter.

11. A rotatable plug as recited in claim 8 wherein both the body means and holding means further comprise mounting holes for rigidly fastening the body means and holding means to one another, the nonconductive disk means and the contact means fastened thereto being rotatably movable within the groove of the holding means with respect to the conductive means after the body means and holding means are fastened together.

12. A rotatable plug as recited in claim 8 wherein the first and second contact means are fastened to the nonconductive disk means on at least one of their ends.

13. A rotatable plug as recited in claim 8 wherein the first and second contact means and the first and second male prong means, respectively, form a single electrical conductor.

14. A rotatable plug as recited in claim 8 wherein the angular distance is substantially defined by the length of one of the arcuate contact surfaces.

15. A rotatable plug as recited in claim 14 wherein the angular distance is 90 degrees.

16. A rotatable plug as recited in claim 8 wherein the frictional contact is sufficient to inhibit undesired spontaneous movement of the first and second contact means with respect to the first and second conductive means.

17. A rotatable plug as recited in claim 8 wherein the electrical appliance is a light.

18. A rotatable plug as recited in claim 8 wherein the angular distance is 90 degrees.

19. A rotatable plug comprising, in combination, first and second male electrical prongs;

first and second arcuate conductive segments in electrical contact with, and rigidly attached to the first and second male electrical prongs, respectively, the first and second arcuate conductive segments being symmetrically arranged with respect to the axis of rotation, in opposed relation to one another and separated at each end by a non-conductive space;

a body comprising first and second conductive contact members mounted thereon, the first and second conductive contact members connected to an electrical appliance, the body and conductive contact members being rotatable a preselected angular distance with respect to the first and second arcuate conductive segments and the first and second electrical prongs fastened thereto, the first and second conductive contact members being in frictional electrical contact with respective first and second arcuate conductive segments throughout rotation, the angular distance substantially defined by the length of one of the arcuate conductive segments;

a nonconductive disk with the first and second arcuate conductive segments fastened to one side thereof, the first and second male electrical prongs extending through the disk and protruding outward from the other side; and a holding member having a circular groove therein, the nonconductive disk and the segments fastened thereto being disposed within and rotatable within the circular groove.

20. A rotatable plug as recited in claim 19 wherein the nonconductive disk includes at least one tab extending radially outward and the groove in the holding member further comprises at least one stop segment, wherein in a preselected position, the tab contacts the stop segment, thereby limiting the angular rotation distance of the nonconductive disk to a preselected amount, and thereby limiting the amount by which the body and conductive contact members mounted thereto rotate with respect to the first and second arcuate conductive segments and the first and second electrical prongs fastened thereto.

21. A rotatable plug as recited in claim 20 wherein the angular distance is 90 degrees.

22. A rotatable plug as recited in claim 19 wherein both the body and holding member further comprise mounting holes for rigidly fastening the body and holding member to one another, the nonconductive disk and the segments fastened thereto being rotatably movable within the groove of the holding member with respect to the contact members after the body and holding member are fastened together.

23. A rotatable plug as recited in claim 19 wherein the first and second arcuate conductive segments are fastened to the nonconductive disk on at least one of their ends.

24. A rotatable plug as recited in claim 19 wherein the first and second arcuate conductive segments and the first and second male electrical prongs, respectively, form a single electrical conductor.

25. A rotatable plug as recited in claim 19 wherein the angular distance is 90 degrees.

26. A rotatable plug as recited in claim 19 wherein the frictional force is sufficient to inhibit undesired spontaneous movement of the body with respect to the first and second arcuate conductive segments and the first and second electrical prongs fastened thereto.

27. A rotatable plug as recited in claim 19 wherein the electrical appliance is a light.

* * * * *